United States Patent [19]

Aono et al.

[11] 4,111,171

[45] Sep. 5, 1978

[54] CLOSED-LOOP MIXTURE CONTROL SYSTEM FOR AN INTERNAL COMBUSTION ENGINE USING SAMPLE-AND-HOLD CIRCUITS

[75] Inventors: Shigeo Aono, Tokyo; Masaharu Asano, Yokohama, both of Japan

[73] Assignee: Nissan Motor Company, Limited, Japan

[21] Appl. No.: 683,670

[22] Filed: May 6, 1976

[30] Foreign Application Priority Data

May 12, 1975 [JP] Japan ..... 50-54613

[51] Int. Cl.[2] ..... F02M 7/00

[52] U.S. Cl. ..... 123/119 EC; 123/32 EE

[58] Field of Search ..... 123/32 EA, 32 EE, 32 EB, 123/32 EC, 32 ED, 119 EC; 60/276

[56] References Cited

U.S. PATENT DOCUMENTS

| | | | |
|---|---|---|---|
| 2,389,797 | 11/1945 | MacNeil et al. | 123/32 EE |
| 3,710,766 | 1/1973 | Beishir | 123/32 EA |
| 3,874,171 | 4/1975 | Schmidt et al. | 60/276 |
| 3,875,907 | 4/1975 | Wessel et al. | 60/276 |
| 3,895,611 | 7/1975 | Endo et al. | 123/32 EE |
| 3,931,808 | 1/1976 | Rachel | 123/32 EE |
| 3,952,710 | 4/1976 | Kawarada et al. | 123/32 EE |
| 3,990,411 | 11/1976 | Oberstadt et al. | 123/32 EA |
| 4,006,718 | 2/1977 | Konomi | 123/32 EE |

*Primary Examiner*—Charles J. Myhre
*Assistant Examiner*—Andrew M. Dolinar
*Attorney, Agent, or Firm*—Robert E. Burns; Emmanuel J. Lobato; Bruce L. Adams

[57] ABSTRACT

A closed-loop mixture control system for an internal combustion engine comprises an exhaust composition sensor, a comparator for comparing the signal derived from the sensor with a reference point to determine whether the air-fuel ratio of the mixture is above or below a desired value, and a sample-and-hold circuit for sampling the comparator output at intervals equal to or longer than the transport delay time of the engine and holding the sampled signals until the next sampling occurs. The output from the sample-and-hold circuit is connected to a controller for proportional amplification to vary the fuel quantity proportionally to the input signal applied thereto. Preferably, the system includes an analog shift register into which is serially clocked the output from the sample-and-hold circuit synchronously with the sampling frequency and then clocked out in parallel form to a weighting network before amplification by the controller.

12 Claims, 6 Drawing Figures

CLOSED-LOOP MIXTURE CONTROL SYSTEM FOR AN INTERNAL COMBUSTION ENGINE USING SAMPLE-AND-HOLD CIRCUITS

BACKGROUND OF THE INVENTION

The present invention relates generally to air-fuel mixture control systems for an internal combustion engine, and particularly to a closed-loop mixture control system using the sampling technique to minimize adversary effect caused by varying operating parameters of the engine.

In a closed-loop mixture control system, a sudden change of an engine operating parameter may introduce a certain degree of control oscillation due to the inherent time delay which is largely accounted for by the transport delay time of the engine from the injection of air-fuel mixture to the sensing of the exhaust composition. Integral control is usually conveniently employed for linearly varying the fuel quantity. However, due to the transport delay time the integral control keeps influencing the fuel quantity in the same direction although the reference point has been passed, resulting in a higher amplitude, lower frequency oscillation.

SUMMARY OF THE INVENTION

The primary object of the invention is to minimize the control oscillation by sampling the instantaneous value of the signal representing the difference between the actual and reference air-fuel ratios and holding the sampled instantaneous value until the next sampling occurs.

In accordance with the present invention, there is provided a closed-loop mixture control system for an internal combustion engine, comprising means for generating a first signal representing an exhaust composition of the engine, means for generating a second signal representing the difference between the first signal and a reference signal to determine whether the mixture is above or below a desired air-fuel ratio, means for sampling the second signal at intervals, means for holding the sampled signal for a predetermined period, a proportional controller for amplifying the signal from the holding means, and means for supplying the mixture to the engine in response to the signal from said proportional controller.

The use of sample-and-hold technique permits the air-fuel mixture to take a moderate air-fuel ratio for engine conditions when external disturbances (sudden changes of engine operating parameters) are introduced, rather than to take a rapid change in air-fuel ratio. The best result can be obtained when the sampling interval is substantially equal to or greater than the transport delay time. In practice, the sampling rate is determined advantageously by the engine speed, and the signals obtained from the conventional ignition distributor are used for sampling purposes.

Another object of the invention is to provide an improved closed-loop mixture control system in which the sampled signal is given a particular weighting factor in time sequence such that the air-fuel ratio is controlled within a minimum range of fluctuations.

In accordance with the invention, the sampled signals are serially clocked into an analog shift register and clocked out in parallel form. Each output is fed into an operational amplifier multiplier to be given a particular weight so that all of the parallel outputs are modulated in amplitude in accordance with a predetermined time schedule suited for particular engine performance and operating conditions.

BRIEF DESCRIPTION OF THE DRAWINGS

These and other objects, features and advantages of the invention will be understood from the following description taken in conjunction with the accompanying drawings, in which.

DESCRIPTION OF THE PREFERRED EMBODIMENTS

Figure 1:
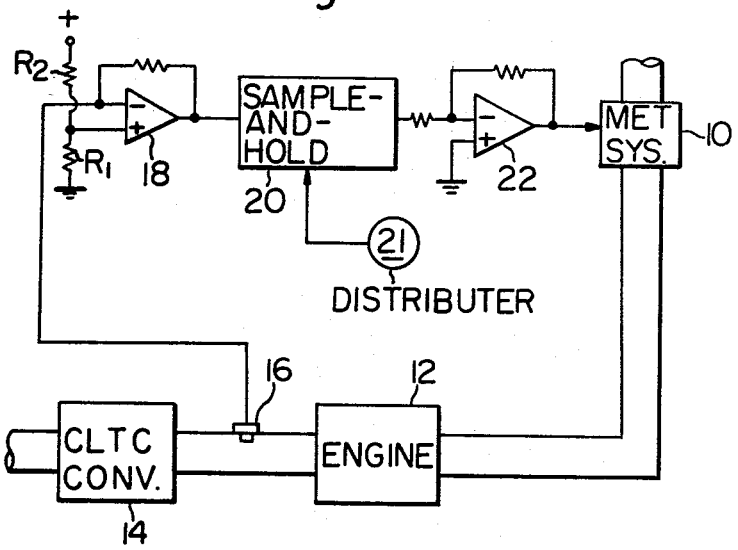
FIG. 1 is a circuit diagram of a closed-loop mixture control system embodying the invention.
Figure 3:
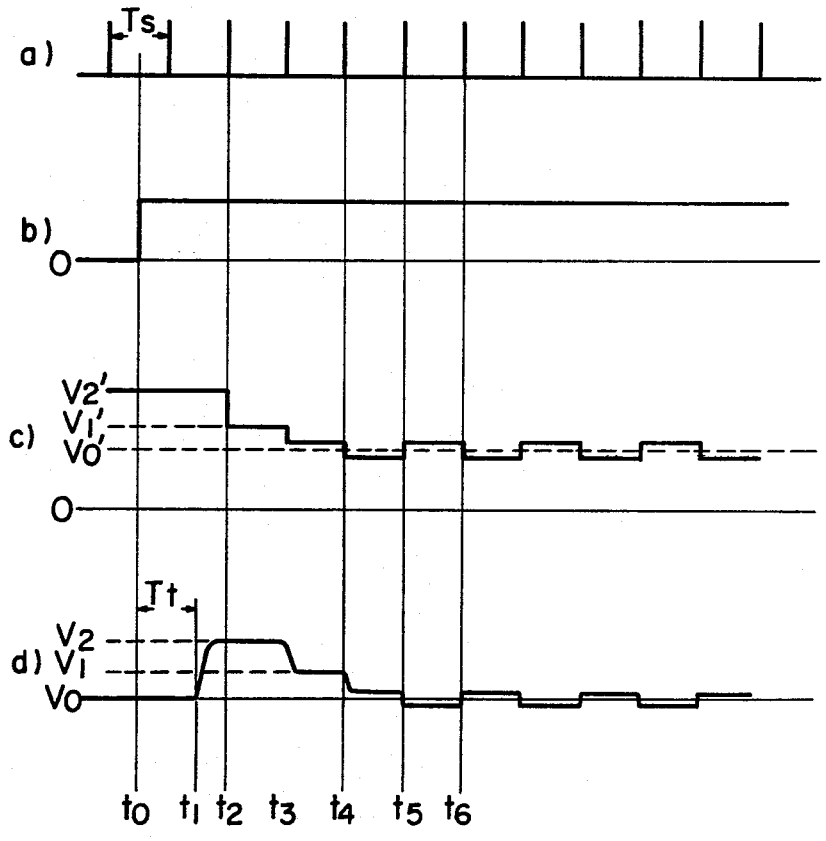
FIG. 3 is a waveform diagram describing the operation of the circuit of FIG. 1.

Referring to FIG. 1 a first embodiment of the invention is illustrated. Through a metering system 10 is supplied air-fuel mixture to an internal combustion engine 12 in the usual manner, which, after combustion, will be exhausted to the atmosphere through a catalytic converter 14 of a three-way catalyst type, for example. An exhaust composition sensor 16 is provided between the exhaust manifold of the engine 12 and the catalytic converter 14 to provide a signal representing the sensed exhaust composition from the engine. The sensor 16 may be of a commercially available zirconium dioxide oxygen sensor having a sharp transition at a reference point or of a type which generates a continuous voltage representing the sensed composition of the exhaust gases. The sensor 16 output is connected to a differential amplifier 18 for comparison with a reference voltage from a voltage divider circuit $R_1$, $R_2$. The reference voltage is so determined that the output from the differential amplifier 18 represents the difference between the actual and desired air-fuel ratios; when the actual ratio is above or below the desired value, a negative or a positive output will be delivered, respectively. The differential amplifier 18 feeds its output to a sample-and-hold circuit 20 to sample the instantaneous value of the amplifier signal at intervals and hold the sampled value of the signal until the next sampling occurs. The sampling interval is preferably equal to or slightly greater than the inherent transport time delay from the time of application of a control signal to the time of occurrence of the resultant effect of the control signal. As will be described below, the sampling is advantageously achieved by use of the signal from an ignition distributor 21. The output from the sample-and-hold circuit 20 is applied to a proportional amplifier 22 which linearly amplifies the input signal applied thereto and supplies its output to the metering system 10 to vary the fuel quantity linearly in opposite direction to the sign of the differential amplifier output so that air-fuel ratio may approach to the desired value. FIG. 3 illustrates the operation of the circuit of FIG. 1. Sampling pulses occur at a constant interval $T_s$ which is equal to or greater than the transport delay time $T_t$. Assume that a disturbance occurred at time $t_0$ (FIG. 3*b*), the output from the composition sensor 16 will increase rapidly at time $t_1$ after the delay time $T_t$ to $V_2$ (FIG. 3*d*). The previous control voltage $V_2'$ (FIG. 3*c*) will keep influencing until time $t_2$ is reached at which point of time a sampling pulse occurs. With this sampling pulse, the instantaneous voltage $V_2$ of sensor 16 output is sampled and as a result the controller voltage is caused to decrease stepwisely from $V_2'$ to $V_1'$. During the sampling interval between times $t_2$ and $t_3$, the sampled voltage $V_2$ is maintained constant in the sample-and-hold circuit 20. The lowering of the controller voltage to $V_1'$ will begin influencing the fuel quantity at time $t_3$ to cause the sensor output to decrease to $V_1$ because of the time delay $T_t$. In such manner the sensor output as well as controller voltage fall stepwisely in step with the sampling interval until they converge to an optimum range of values close to the reference points $V_0$ and $V_0'$, respectively. It will be appreciated that the controller 22 keeps influencing the fuel quantity in the same direction until time $t_5$ is reached. During interval between $t_5$ and $t_6$, the fuel quantity is reversely controlled by the previous value of the controller output during times $t_4$ and $t_5$. Since the sampled signal is held constant as long as one sampling period, the controller will not keep influencing the system after the next sampling pulse has occurred. Therefore, there will be no excessive reverse direction control during the interval between $t_5$ and $t_6$. Since the transport delay time $T_t$ substantially corresponds to the period of one engine cycle, the air-fuel ratio is converged discretely in step with the cylinder cycle to the reference point.

Figure 2:
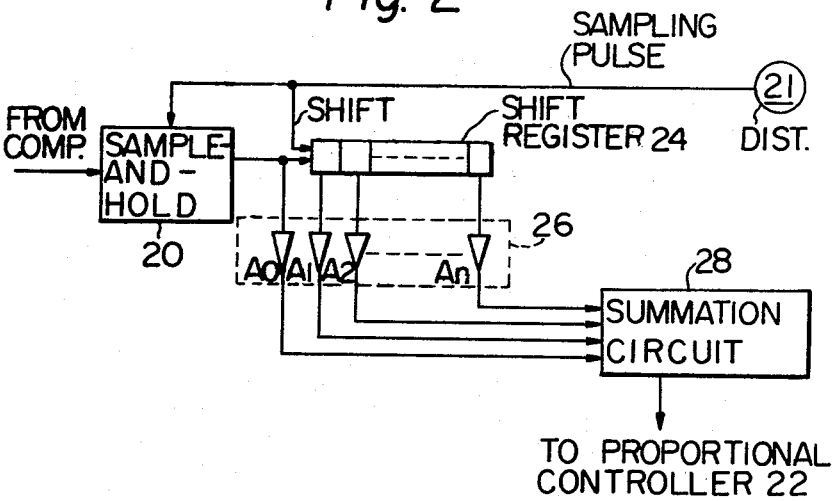
FIG. 2 is a modification of the present invention.
Figure 4A:
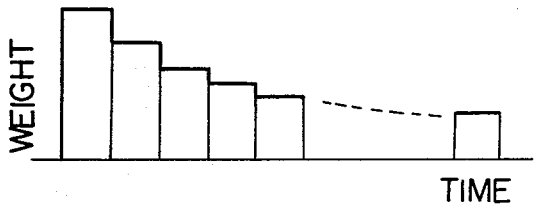
FIGS. 4*a* and 4*b* are illustrations showing weighting factors as a function of time.
Figure 4B:
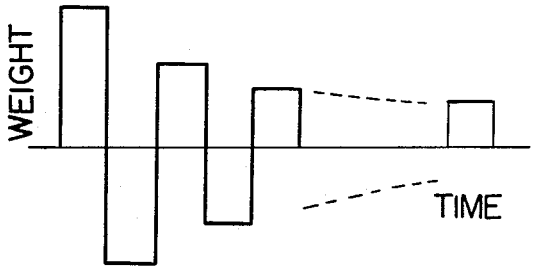

FIG. 2 illustrates a modified form of the present invention in which an analog shift register 24 is connected to the output of the sample-and-hold circuit 20 to receive the sampled signals on its data input in step with the sampling pulse applied to its shift input. The shift register 24 includes a row of analog storage elements connected in series to the data input terminal to accept each sampled signal clocked thereinto in synchronism with the sampling interval so that each stored signal is preceded by a signal which occurs before time $T_s$. There is also provided a weighting network 26 including a plurality of operational amplifiers $A_1$ to $A_n$ each connected to each storage element of the shift register 24. The weighting network 26 is preferably provided with another operational amplifier $A_0$ connected to the data input of shift register 24. The operational amplifiers are designed to possess different values of amplification so that each stored signal is given a particular weighting factor or amplification. Each weighting factor is determined by the particular engine characteristics or the mode of operation as a function of time. Therefore, the most recent signal that appears on the data input is weighted by operational amplifier $A_0$ and the signal that precedes it by one sampling period is weighted by operational amplifier $A_1$, and so on. The outputs from the operational amplifiers are thus weighted in accordance with a particular characteristic which may, for example, decrease exponentially with time as illustrated in FIG. 4*a* or decrease exponentially with time while alternating in opposite directions as shown in FIG. 4*b*. The outputs from the operational amplifiers $A_0$ to $A_n$ are connected to a summation circuit 28 in which the weighted signals are all summed up to give a resultant output to the proportional amplifier 22.

Figure 5:
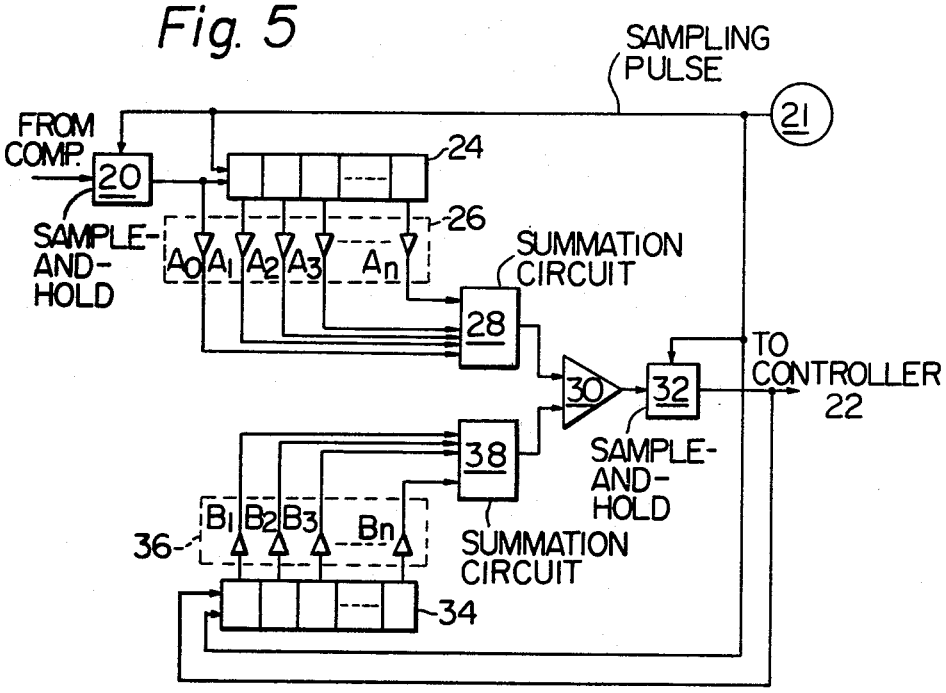
FIG. 5 is a further modification of the invention.

A further modification of the present invention is shown in FIG. 5, in which like numbers indicate like parts. The output from the summation circuit 28 is connected to one input of a coupling circuit 30 which connects its output to a sample-and-hold circuit 32. The output from the sample-and-hold circuit 32 is fed to the proportional amplifier 22 as well as to the data input of an analog shift register 34 having a similar construction to that of shift register 24. A second weighting network 36 comprised by a plurality of operational amplifiers $B_1$ to $B_m$ is provided. Each opertional amplifier is connected to each analog storage element of the shift register 34 in the same manner as the weighting network 26. The output of each operational amplifier is connected to a summation circuit 38 whose output is connected to another input of the coupling circuit 30.

The coupling circuit 30 may comprise a conventional adder circuit to provide summation of the weighted signals from both summation circuits 28 and 38. The sample-and-hold circuit 32 is sampled by the same sampling rate as the sample-and-hold circuit 20. The same sampling pulse as supplied to the sample-and-hold circuit 32 is also connected to the shift register 34 to clock the sampled signals thereinto. The operational amplifiers $B_1$ to $B_m$ possess different weighting factors which are selected in a manner as described before. The weighted signals are parallelly fed into the summation circuit 38. The signals from both summation circuits 28 and 38 are thus fed back to the coupling circuit 30. This feedback operation creates a signal waveform that is not available with the conventional integral controller. Therefore, the output from summation circuit 28 is sampled again at 32, converted into a series of weighted signals, and clocked out in parallel in step with the sampling interval, which is preferably equal to or greater than the transport delay time of the engine, and combined with the oncoming signal from the summation circuit 28.

The circuit 30 may be a subtractor to generate a signal representing the difference between the signals from the summation circuits 28, 38. The types of circuit 30 is determined by the desired signal waveform for particular types of engine or mode of operation. Therefore, an adder or a subtractor may be employed.

Let A denote the signal transmission characteristic of the circuit including the shift register 24, weighting network 26 and summation circuit 28 and B the transmission characteristic of the circuit including the shift register 34, weighting network 36 and summation circuit 38, the following relation holds:

Control Signal = Differential Amplifier Output $$(\text{D.A.O.}) \times \frac{A}{1+B} \tag{1}$$

Equation (1) is rewritten as follows:

$$\text{Control Signal} = \text{D.A.O.} \times \frac{a_o + a_1 z + a_2 z^2 + \ldots + a_n z^n}{1 + b_1 z + b_2 z^2 + \ldots + b_m z^m} \tag{2}$$

where, "*z*" is a unit delay time, "*a*" and "*b*" are the weighting factors of the operational amplifiers $A_0$ to $A_n$ and $B_0$ to $B_m$, of weighting networks 16 and 34, respectively. It follows from Equation (2) that if the weighting factors "*a*" and "*b*" are suitably selected, the control signal will have a desired integrating or differential response characteristic.

It will be understood that since the drive signal appearing at the output of sample-and-hold circuit 32 has a waveform which varies to meet the changing engine parameters, the necessity of having an integral controller as in the prior art mixture control system can be eliminated. Therefore, only linear proportional amplification is necessary for driving the metering system 10.

What is claimed is:

1. A closed-loop mixture control system for an internal combustion engine, comprising means for generating a first signal representing the concentration of a composition of exhaust gases from the engine, means for generating a second signal representing the deviation of the first signal from a reference value indicative of a desired air-fuel ratio, means for sampling the second signal at intervals, means for holding the sampled signal until the next sampling occurs, means for storing the signal from said holding means along a row of storage elements from one element to another in step with the occurrence of said sampling, a weighting network for respectively multiplying the stored signals by constant values of different magnitude, means for providing summation of the weighted signals, and a proportional controller for amplifying the signal from the summation means, and means for supplying the mixture to the engine in response to the signal from said proportional controller.

2. A closed-loop mixture control system as claimed in claim 1, wherein said weighting network comprises a plurality of operational amplifiers connected to said analog storage elements.

3. A closed-loop mixture control system as claimed in claim 2, wherein the weighting network has a weighting function which decreases stepwisely towards the end of the row of said storage elements opposite to the input end of the row.

4. A closed-loop mixture control system as claimed in claim 2, wherein the weighting network has a weighting function which decreases towards the end of the row opposite to the input end of the row and alternates between opposite signs.

5. A closed-loop mixture control system for an internal combustion engine comprising means for generating a first signal representing the concentration of a composition of exhaust gases from the engine, means for generating a second signal representing the deviation of the first signal from a reference value indicative of a desired air-fuel ratio, means for sampling the second signal at intervals, means for holding the sampled signal until the next sampling occurs, first means for storing the signal from said holding means along a row of analog storage elements from one element to another in step with the occurence of said sampling, a first weighting network for respectively multiplying the signals stored in said first storage means by constant values of different magnitudes, first means for providing summation of the weighted signals, an arithmetic circuit having a first input connected to said first summation means and a second input, second means for sampling the output from said arithmetic circuit at intervals, second means for holding the sampled signal from said second sampling means until the next sampling occurs, second means for storing the signal from said second holding means along a row of analog storage elements from one element to another in step with the occurrence of said sampling of said second sampling means, a second weighting network for respectively multiplying the signals stored in said second storage means by constant values of different magnitudes, second means for providing summation of the weighted signals from the second weighting network for application of the output thereof to the second input of said arithmetic circuit, a proportional controller for amplifying the output from second holding means, and means for supplying the mixture to the engine in response to the output from said proportional controller.

6. A closed-loop mixture control system as claimed in claim 5, wherein said arithmetic circuit is an adder providing summation of the signals from the first and second summation means.

7. A closed-loop mixture control system as claimed in claim 5, wherein said circuit is a subtractor providing a signal representing the difference between the signals from said first and second summation means.

8. A closed-loop mixture control system as claimed in claim 5, wherein each of said first and second weighting networks comprises a plurality of operational amplifiers connected to said analog storage elements of the respective networks.

9. A closed-loop mixture control system as claimed in claim 8, wherein the first weighting network has a weighting function which decreases stepwisely towards the end of the row of said storage elements opposite to the input end of the row.

10. A closed-loop mixture control system as claimed in claim 8, wherein the first weighting network has a weighting function which decreases towards the end of the row of said storage elements opposite to the input end of the row and alternates between opposite signs.

11. A closed-loop mixture control system as claimed in claim 8, wherein the second weighting network has a weighting function which decreases stepwisely towards the end of the row of said storage elements opposite to the input end of the row.

12. A closed-loop mixture control system as claimed in claim 8, wherein the second weighting network has a weighting function which decreases towards the end of the row of said storage elements opposite to the input end of the row and alternates between opposite signs.

* * * * *